US007949144B2

(12) United States Patent
Harsch et al.

(10) Patent No.: US 7,949,144 B2
(45) **Date of Patent: *May 24, 2011**

(54) METHOD FOR MONITORING A HEARING DEVICE AND HEARING DEVICE WITH SELF-MONITORING FUNCTION

(75) Inventors: Samuel Harsch, Ballaigues (CH); Evert Dijkstra, Fontaines (CH)

(73) Assignee: Phonak AG, Staefa (CH)

( * ) Notice: Subject to any disclaimer, the term of this patent is extended or adjusted under 35 U.S.C. 154(b) by 1381 days.

This patent is subject to a terminal disclaimer.

(21) Appl. No.: 11/423,528

(22) Filed: Jun. 12, 2006

(65) Prior Publication Data

US 2007/0286441 A1 Dec. 13, 2007

(51) Int. Cl.
*H04R 25/00* (2006.01)

(52) U.S. Cl. ..... 381/312; 381/317; 381/318

(58) Field of Classification Search ..... 381/23.1, 381/60, 312, 316–318, 328
See application file for complete search history.

(56) References Cited

U.S. PATENT DOCUMENTS

| | | | | |
|---|---|---|---|---|
| 3,659,056 | A * | 4/1972 | Morrison et al. | 381/315 |
| 4,087,629 | A * | 5/1978 | Atoji et al. | 381/309 |
| 4,303,800 | A * | 12/1981 | DeFreitas | 381/18 |
| 6,269,318 | B1 | 7/2001 | Geddes | |
| 6,975,739 | B2 * | 12/2005 | Bogason et al. | 381/315 |
| 2004/0202333 | A1 | 10/2004 | Csermak et al. | |

FOREIGN PATENT DOCUMENTS

| | | | |
|---|---|---|---|
| EP | 1 276 349 | B1 | 9/2004 |
| EP | 1638367 | A2 | 3/2006 |
| WO | 0001196 | A1 | 1/2000 |
| WO | 2005125276 | A1 | 12/2005 |

* cited by examiner

*Primary Examiner* — Suhan Ni
(74) *Attorney, Agent, or Firm* — Roberts Mlotkowski Safran & Cole, P.C.; David S. Safran

(57) ABSTRACT

There is provided a method for monitoring a hearing device having an electroacoustic output transducer worn at a user's ear or in a user's ear canal, the method includes the steps of measuring the electrical impedance of the output transducer; analyzing the measured electrical impedance of the output transducer in order to evaluate the status of the output transducer and/or of an acoustical system cooperating with the output transducer; and outputting a status signal representative of the status of the output transducer and/or of the acoustical system cooperating with the output transducer.

22 Claims, 5 Drawing Sheets

METHOD FOR MONITORING A HEARING DEVICE AND HEARING DEVICE WITH SELF-MONITORING FUNCTION

BACKGROUND OF THE INVENTION

1. Field of the Invention

The invention relates to a method for monitoring a hearing device comprising an electro-acoustic output transducer worn at a user's ear or in a user's ear canal. The invention also relates to such a hearing device having self-monitoring function. According to another aspect, the invention relates to a method for adjusting a behind-the-ear hearing device and also to such an adjustable behind-the-ear hearing device.

2. Description of Related Art

Ear-worn hearing devices, such as hearing aids (which have an integrated microphone system) or wireless systems (which comprise a remote audio signal source, such as a remote microphone, and an ear-piece receiver) usually comprise an electro-acoustic output transducer (loudspeaker) which is located in or at least close to the ear canal. This applies particularly to in-the-ear (ITE) or completely in-the-canal (CIC) systems. However, also behind-the-ear (BTE) systems have a tubing extending from the loudspeaker (which in this case is located behind the ear) into the ear canal. A frequent problem of such ear-worn hearing devices is that the performance of the loudspeaker may be significantly deteriorated due to blocking with ear wax (cerumen) from the ear canal.

It is known to use special wax filters in order to protect the loudspeaker for preventing the loudspeaker from getting blocked by wax. However, none of these wax filters is capable of providing for a full protection from wax blocking.

If the loudspeaker performance is deteriorated by wax blocking, the user may not immediately notice this. This may be particularly true for systems used by children, since they usually have much more difficulty in noticing and communicating problems regarding the hearing device.

EP 1 276 349 B1 relates to a hearing aid with a self-test capability, wherein the hearing-aid automatically undergoes a self-test procedure for determining whether the hearing aid comprises a defect. The hearing aid is capable to indicate the presence and the type of defect to the user, for example, on the display of a programming device connected to the hearing aid for service purposes. During the self-test procedure it is checked whether each of the hearing aid microphones produces a signal. From the absence of such signal it is concluded that the input port to the respective microphone has been occluded by ear wax.

It is one object of the invention to provide for a method for monitoring a hearing device comprising an electio-acoustic output transducer worn at a user's ear or in a user's ear canal, by which method it should be enabled to monitor the acoustic performance of the output transducer in a simple and efficient manner. In addition, such hearing device having a monitoring function should be provided.

It is a further object of the invention to provide for a method for adjusting a behind-the-ear hearing device comprising an electroacoustic output transducer connected to a tubing (26) extending into a user's ear canal. In addition, such a hearing device should be provided.

SUMMARY OF THE INVENTION

According to a first aspect of the invention there is provided a method comprising the steps of measuring an electrical impedance of said output transducer; analyzing the measured electrical impedance of the output transducer in order to evaluate a status of the output transducer and/or an acoustical system cooperating with the output transducer; and outputting a status signal representative of the status of the output transducer and/or the acoustical system cooperating with said output transducer. Also, in accordance with first aspect, a hearing device is provided with self-monitoring function, comprising an electroacoustic output transducer to be worn at or in a user's ear canal, means for measuring an electrical impedance of said output transducer, means for analyzing said measured electrical impedance of said output transducer in order to evaluate the status of the output transducer and/or an acoustical system cooperating with the output transducer, and means for outputting a status signal representative of the status of the output transducer and/or the acoustical system cooperating with said output transducer.

According to a second aspect of the invention there is provided a method for adjusting a behind-the-ear hearing device having an electroacoustic output transducer connected to a tubing extending into a user's ear canal, involving the steps of measuring an electrical impedance of said output transducer, analyzing the measured electrical impedance of the output transducer to determine at least one parameter selected from a length of the tubing and a diameter of the tubing, and adjusting operation parameters of the hearing device according to the at least one parameter determined to optimize an acoustical performance of said hearing device. Also, in accordance with second aspect, a hearing device is provided having an electroacoustic output transducer connected to a tubing adapted for extending into a user's ear canal, means for measuring an electrical impedance of the output transducer, means for analyzing the measured electrical impedance of the output transducer in order to determine at least one parameter selected from a length of said tubing and a diameter of said tubing, and means for providing a signal representative of the at least one parameter for adjusting operation parameters of the hearing device to optimize acoustical performance of the hearing device.

The invention is generally beneficial in that, by measuring and analyzing the electrical impedance of the output transducer, the status of the output transducer and/or of an acoustical system cooperating with the output transducer, such as a tubing of a BTE hearing device, may be evaluated in a simple and efficient manner. According to one aspect, thereby it is enabled to automatically and immediately recognize when the output transducer or an acoustical system cooperating with the output transducer is blocked by ear wax or when the output transducer is damaged. According to another aspect, thereby the length and/or diameter of the tubing of a BTE hearing device can be automatically determined in a simple manner, and the thus determined length and/or diameter of the tubing can be used to optimize the operation parameters of the hearing device according the determined length and/or diameter of the tubing in order to optimize the acoustical performance of the hearing device.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
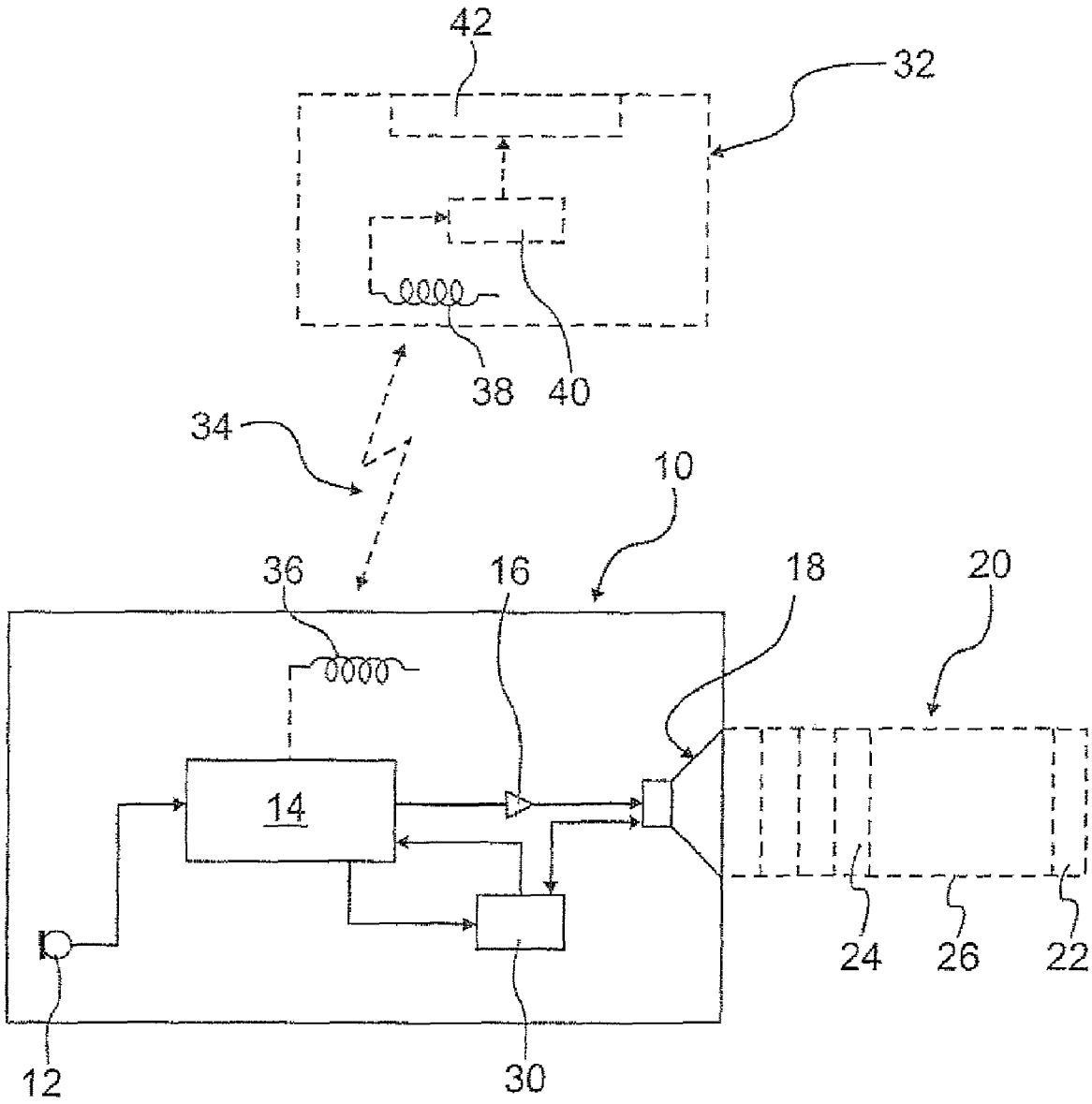
FIG. 1 is a block diagram of a first embodiment of a hearing device according to the invention.

FIG. 1 is a block diagram of a first example of a hearing device for which the invention can be used, wherein the hearing device is a hearing aid 10 which comprises a microphone arrangement 12 (which may consist of two spaced-apart microphones for enabling acoustic beam forming capability), a central processing unit 14 for processing the audio signals produced by the microphone arrangement 12, a power amplifier 16 for amplifying the processed audio signals from the central processing unit 14, and a loudspeaker 18 for stimulating the user's hearing with the processed amplified audio signals from the microphone arrangement 12. The hearing aid 10 could be of the ITE or CIC type, in which cases the loudspeaker 18 would be located in the ear canal of the user.

The loudspeaker 18 may cooperate with an acoustical system 20 located downstream of the loudspeaker 18, which may comprise, for example, a wax filter 22, acoustical filters 24 and some kind of tubing 26. Such tubing 26 will have a significant length if the hearing aid 10 is of the BTE type, in which case the loudspeaker, together with the hearing aid 10, will be located behind the ear, while the tubing 26 extends into the ear canal.

Figure 2:
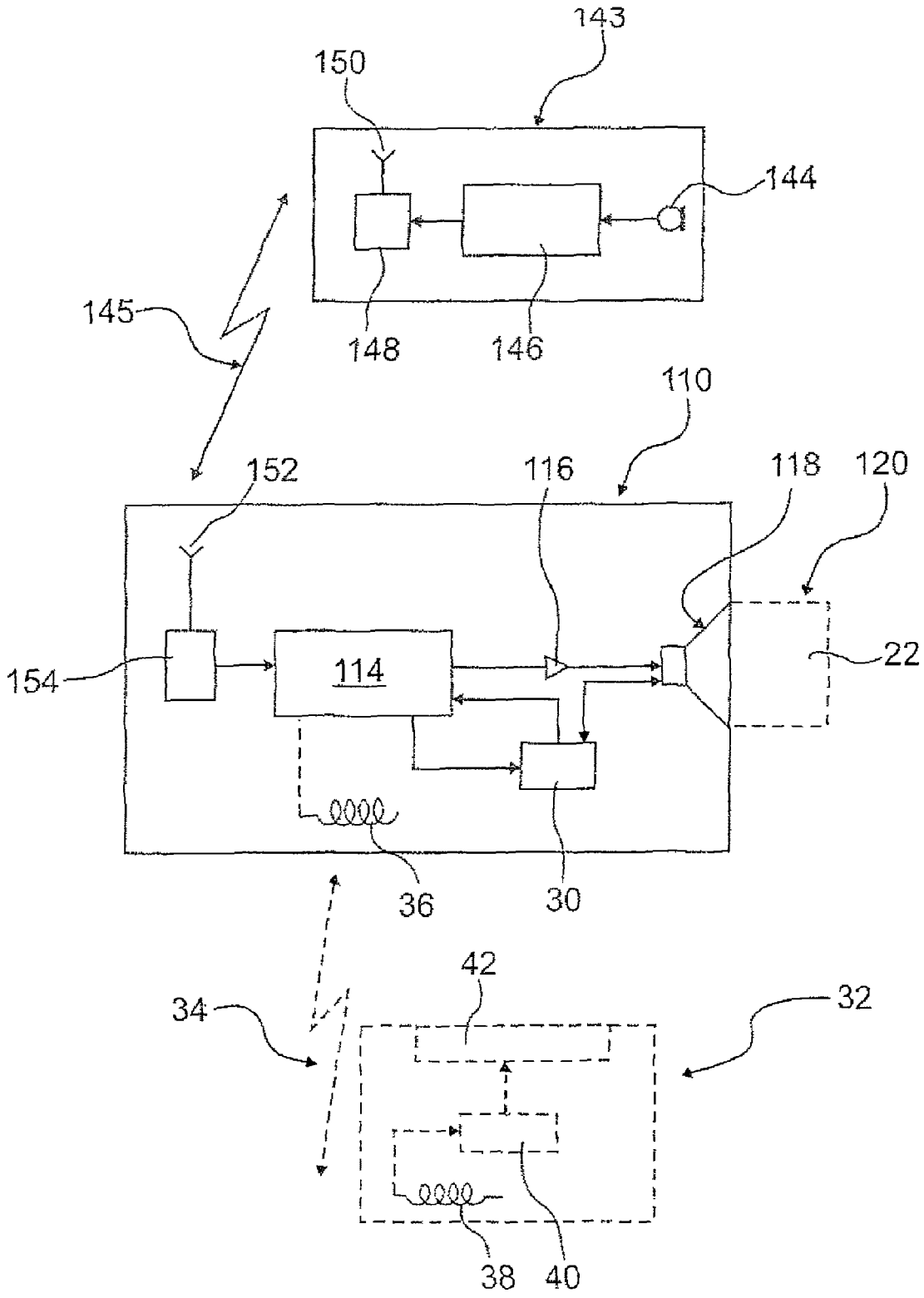
FIG. 2 is a block diagram of a second embodiment of a hearing device according to the invention.

FIG. 2 is a block diagram of an alternative embodiment of a hearing device, wherein the hearing device is a wireless ear-piece 110 which represents the receiver unit of a wireless audio system and which receives audio signals from a remote transmission unit 143 via a wireless audio link 145.

The transmission unit comprises a microphone arrangement 144 (which may consist of two or more spaced-apart microphones for enabling acoustic beam forming capability), an audio signal processing unit 146 for processing the audio signals from the microphone arrangement 144, a transmitter 148 and an antenna 150. Usually the audio link 145 will be an FM link.

The receiver unit 110 comprises an antenna 152, a receiver 154 for recovering the audio signals from the signal received at the antenna 152, a central processing unit 114 for processing the received audio signals, a power amplifier 116 for amplifying the processed audio signals, and a loudspeaker 118. As in the example of FIG. 1, the loudspeaker 118 may cooperate with an acoustical system located downstream of the loudspeaker 118, for example, a wax filter 22. As in the case of FIG. 1, the loudspeaker 118 will be located in or at the ear canal. The loudspeaker 118 may be integrated into the receiver unit 110, as shown in FIG. 2, or it may be mechanically and electrically connected thereto.

Both in the embodiment of FIG. 1 and the embodiment of FIG. 2 an analyzer unit 30 is provided which may be activated by the central processing unit 14, 114 and which serves to measure the electrical impedance as a function of frequency of the loudspeaker 18, 118 and to provide the corresponding measurement result to the central processing unit 14, 114 in order to enable the central processing 14, 114 to produce a status signal representative of the status of the loudspeaker 18, 118 and/or the acoustical system 20, 120 cooperating with the loudspeaker 18, 118. The measured electrical impedance as a function of frequency of the loudspeaker 18, 118 provided by the analyzer unit 30 is evaluated in the central processing unit 14, 114 in order to generate the respective status signal.

According to one embodiment, an acoustic alarm signal may be produced by the central processing unit 14, 114 with the help of the loudspeaker 18, 118 in order to provide the user with an acoustic alarm. Such acoustic alarm may comprise an alarm tone and/or a voice message.

According to an alternative embodiment, the status signal may be transmitted from the central processing unit 14, 114 to a remote device 32 via a wireless link 34 which possibly is an inductive link utilizing an inductive antenna 38 included in the remote device 32 and an inductive antenna 36 connected to the central processing unit 14, 114. The remote device 32 further includes a signal processing unit 40 for processing the signals received by the antenna 38 and a display 40 for displaying the alarm signal received via the inductive link 34, which in this embodiment will be an optical alarm signal rather than an acoustic alarm signal.

The remote device 32 could be used by the user of the hearing device 10, 110, or, in particular in the case of FIG. 2, it could be used by the person using the transmission unit 143, for example, the teacher in a classroom of pupils using the receiver unit 110. In this case, the remote device 32 could be functionally integrated within the transmission unit 143.

The inductive link 34 may be bidirectional link. In this case, transmission of the status signal from the hearing device 10, 110 may be initiated by receipt of a polling command at the hearing device 10, 110 transmitted from the remote device 32. Thereby, for example, the teacher in the classroom may check whether the loudspeaker 118 used by each pupil works properly. In addition, the bidirectional link 34 may serve to monitor also other components of the system, such as battery status, status of the audio link 145, etc.

According to an alternative embodiment, rather than being initiated by receipt of a polling signal, measurement of the electrical impedance of the loudspeaker 18, 118 and the subsequent analysis of the measured electrical impedance will be repeated in regular intervals.

Preferably, the measured electrical impedance as a function of frequency will be analyzed by comparing the measured electrical impedance to reference data stored in the hearing device 10, 110. Such reference data may be generated in the manufacturing process of the hearing device 10, 110. Preferably the resonance frequency and/or the quality factor of the loudspeaker 18, 118 are analyzed by measuring the electrical impedance as a function of frequency. Preferably the status signal will be provided as all alarm signal if the difference between the actually measured electrical impedance data and the stored reference data exceeds a predetermined threshold, wherein the magnitude of the difference between the measured data and the stored reference data may be taken as a measure of the degree of disturbance of the loudspeaker 18, 118, for example of the degree of the mechanical obstruction of the loudspeaker 18, 118 by ear wax.

The evaluation of the status of loudspeaker 18, 118 and/or the acoustical system 20, 120 cooperating with the loudspeaker 18, 118 may include an evaluation of whether the loudspeaker 18, 118 is working according to specification.

Preferably such evaluation will include a check of whether the loudspeaker is still working properly or whether it is out of order.

In the case of a BTE hearing aid the system will include a tubing 26 extending from the loudspeaker 18 into the user's ear canal. The length and/or the diameter of such tubing 26 can be selected individually by the fitter. If the length/diameter of the tubing 26 is known, the acoustical performance of the BTE hearing aid can be optimized. Due to the acoustical coupling of the tubing 26 to the loudspeaker 18 it is possible to estimate from the measured electrical impedance of the loudspeaker 18 the length/diameter of the tubing 26 used for each BTE hearing aid 10. With this knowledge, it is possible to optimize the acoustical performance of the hearing device automatically by optimizing the setting the operation parameters of the hearing aid according to the determined length/diameter of the tubing 26, eliminating therefore the need for the fitter to enter the length/diameter data into the computer (not shown) for a fine tuning procedure, thus saving time and avoiding possible errors. To this end, the central processing unit 14 of the hearing aid 10 may provide for a signal representative of the determined length/diameter of the tubing 26, which signal is supplied to the fitting computer.

In addition to evaluating the length/diameter of the tubing 26 from the measured electrical impedance of the loudspeaker 18 it is also possible to evaluate whether the end of the tubing 26 suffers from a mechanical obstruction, for example by ear wax.

Figure 3:
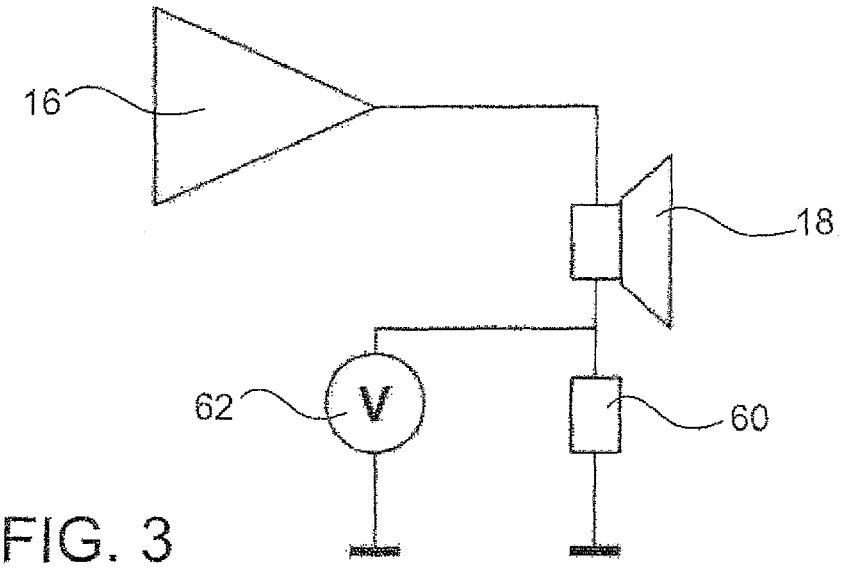
FIG. 3 is an example of how the electrical impedance of the output transducer of a hearing device according to the invention may be measured.

An example of how the measurement of the electrical impedance of the loudspeaker 18, 118 can be done by the analyzer unit 30 as given in FIG. 3. According to FIG. 3, the voltage on a serial resistor 60 located between the ground and the loudspeaker 18 is measured by voltmeter 62. For such an arrangement the voltage curve (i.e. the voltage as a function of frequency) on the resistor 60 becomes the image of the impedance curve of the loudspeaker 18. The electric impedance—and hence the voltage measured by the voltmeter 62—will be different depending on whether the loudspeaker is open or blocked. Even if the loudspeaker 18 is only partly blocked (resulting in a relatively small acoustic attenuation), a change in voltage will be observed.

Figure 4:
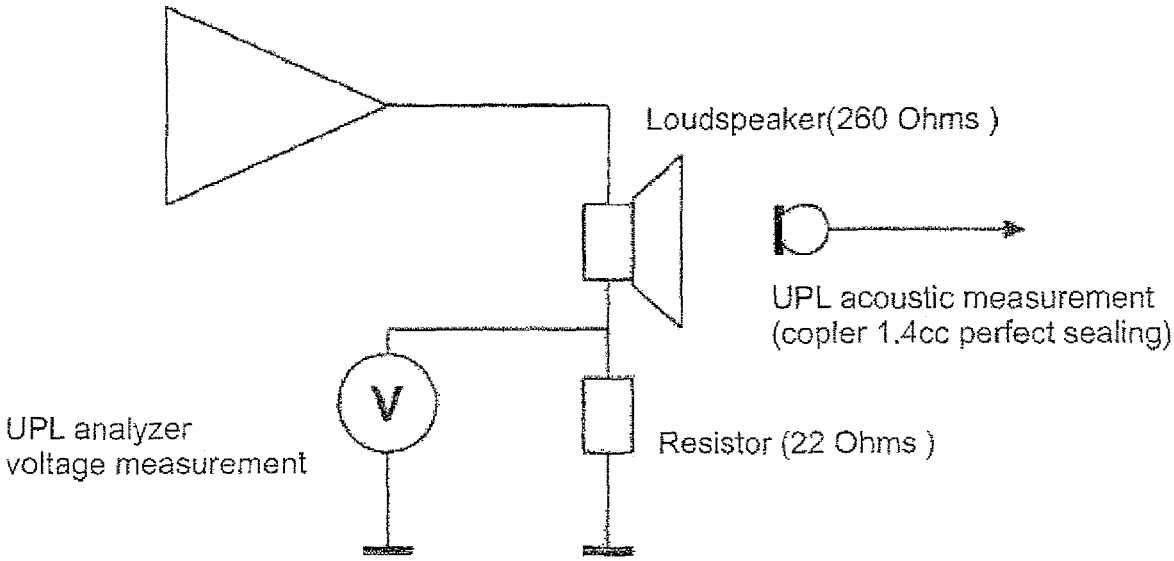
FIG. 4 shows schematically the set-up for the test measurements of FIGS. 5 and 6.

Test measurements have been performed with the set-up of FIG. 4, wherein the resistor 60 had a resistance of 22 Ohms, the loudspeaker 18 had a resistance of 260 Ohms and the acoustic output level measurements were performed in a 1.4 cc coupler with perfect sealing.

Figure 5:
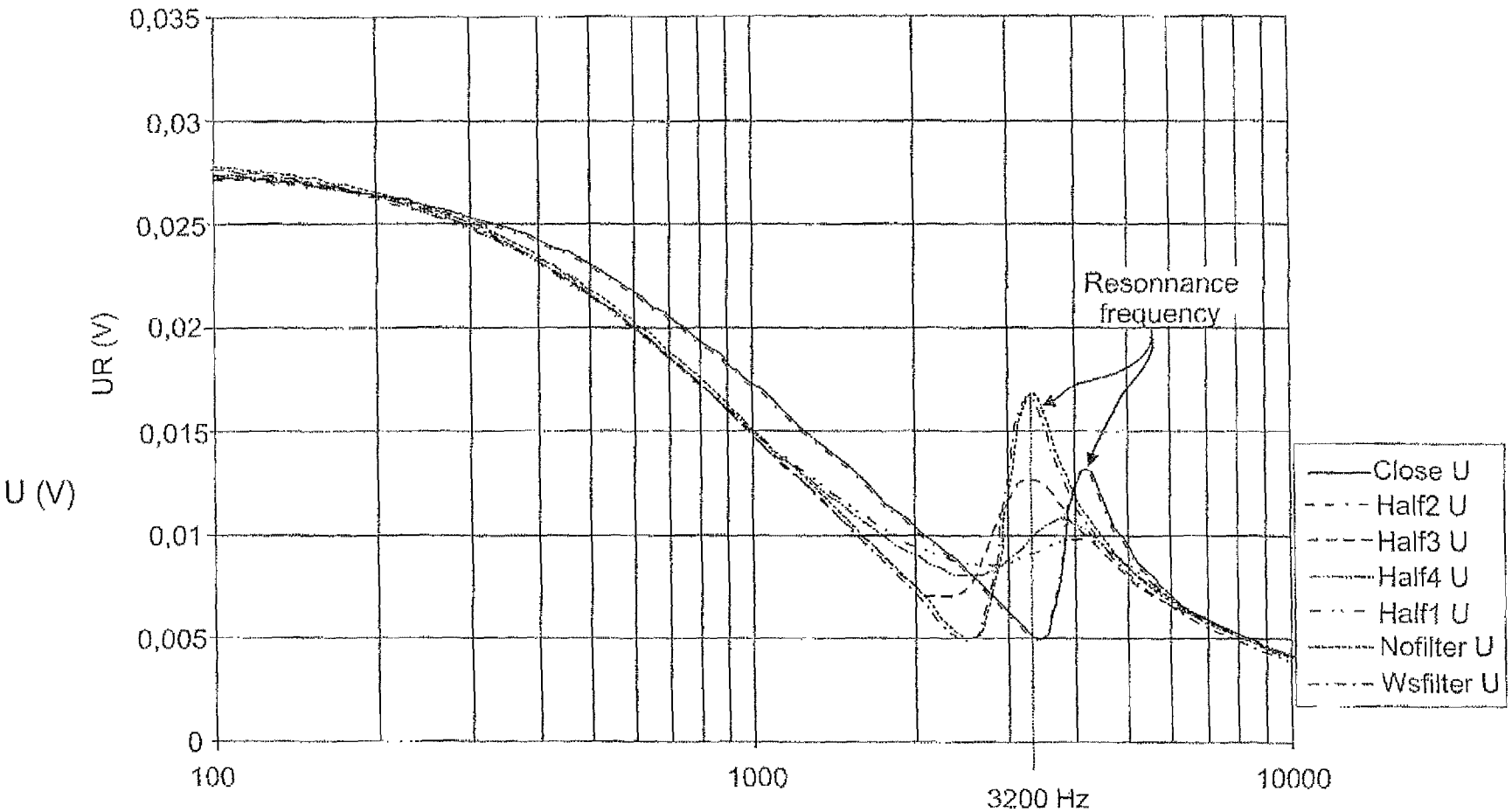
FIG. 5 is a plot of the voltage measured at the resistor of FIG. 4 as a function of frequency obtained in test measurements with the set-up of FIG. 4 for different obstruction levels of the loudspeaker.

FIG. 5 shows the voltage measured at the resistor 60 as a function of frequency for different levels of obstruction, namely for totally closed filter (close acoustic output, labeled "close"), different intermediate levels of obstruction (partly closed acoustic output, labeled "Half 1" to "Half 4", measurement without filter (open acoustic output, labeled "Nofilter") and measurement with filter (open acoustic output, labeled "Wsfilter"). The loudspeaker 18 was fluid damped.

According to FIG. 5, different voltage levels are obtained for different obstruction levels of the loudspeaker 18, 118. The voltage difference is obviously the largest at the resonance frequency of the loudspeaker 18, 118 (in the present case about 3,200 Hz). In the case of small obstruction the quality factor decreases due to the parasitic acoustical resistance. For a totally blocked filter, the air volume between the loudspeaker 18 and the "stopper" creates a compliance (acoustic capacitor) in parallel with the standard compliance of the loudspeaker diaphragm. If the acoustic resistor is replaced by a compliance, the quality factor increases, but the resonance frequency also increase to about 4,000 Hz.

Figure 6:
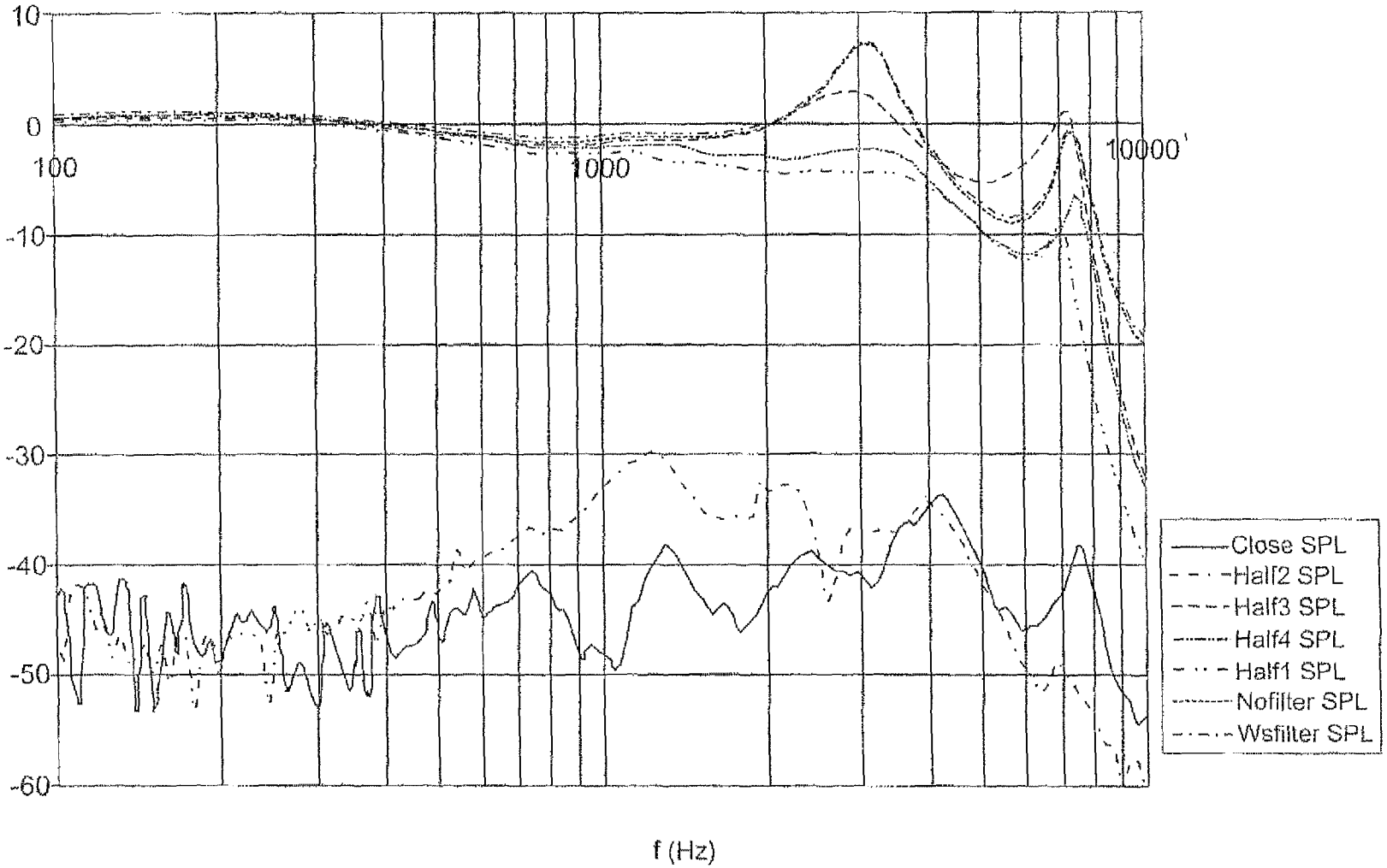
FIG. 6 is a plot of the acoustic output level curve of the loudspeaker measured with the set-up of FIG. 4 in a 1.4 cc coupler for different loudspeaker obstruction levels.

FIG. 6 shows the acoustic output level of the loudspeaker 18 measured in a 1.4 cc coupler as a function of frequency for the various obstruction levels of FIG. 5.

According to one embodiment, the resonance frequency of the loudspeaker in free space is stored in the hearing device 10, 110 during the manufacturing process. Later, when the hearing device 10, 110 is operated, the analyzer unit 30 generates the stored resonance frequency and measures the voltage on the resistor 60 at this frequency. If the measurement shows too much of a difference, an alarm signal is created, as already explained above, for example, telling the user that the loudspeaker is blocked and should be cleaned.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A method for monitoring a hearing device comprising an electroacoustic output transducer worn at a user's ear or in a user's ear canal, comprising the following steps (a) to (c):

(a) measuring an electrical impedance of said output transducer;

(b) analyzing said measured electrical impedance of said output transducer in order to evaluate a status at least one of said output transducer and an acoustical system cooperating with said output transducer; and (c) outputting a status signal representative of said status of at least one of said output transducer and said acoustical system cooperating with said output transducer.

2. The method of claim 1, wherein the steps (a) to (c) are repeated in regular intervals.

3. The method of claim 1, wherein said output transducer is located in said user's ear canal.

4. The method of claim 3, wherein said hearing device is selected from the group consisting of an in-the-ear hearing aid and a wireless audio signal receiver unit.

5. The method of claim 3, wherein said evaluation of said status of at least one of said output transducer and said acoustical system cooperating with said output transducer includes an evaluation of whether said output transducer is mechanically blocked.

6. The method of claim 5, wherein said evaluation of said status of at least one of said output transducer and said acoustical system cooperating with said output transducer includes an evaluation of an extent to which said output transducer is mechanically blocked.

7. The method of claim 1, wherein said evaluation of said status of at least one of said output transducer and said acoustical system cooperating with said output transducer includes an evaluation of whether said output transducer is working according to specification.

8. The method of claim 1, wherein an acoustic alarm signal is provided to said user according to said status signal.

9. The method of claim 8, wherein said acoustic alarm signal is provided via said output transducer.

10. The method of claim 8, wherein said acoustic alarm signal comprises at least one of an alarm tone and a voice message.

11. The method of claim 1, wherein said hearing device is a behind-the-ear hearing aid comprising a tubing extending from said output transducer into said user's ear canal.

12. The method of claim 11, wherein said evaluation of said status of at least one of said output transducer and said acoustical system cooperating with said output transducer includes an evaluation of at least one of a mechanical obstruction of said tubing, a length of said tubing and a diameter of said tubing.

13. The method of claim 1, wherein said status signal is transmitted from said hearing device to a remote device via a wireless link.

14. The method of claim 13, wherein at least one of an acoustic alarm signal and an optical alarm signal is provided by said remote device according to said status signal.

15. The method of claim 14, wherein said status signal is transmitted from said hearing device to said remote device upon receipt of a polling command transmitted from said remote device by said hearing device.

16. The method of claim 1, wherein in step (b) said measured electrical impedance is analyzed by comparing said measured electrical impedance to reference data stored in said hearing device.

17. The method of claim 16, wherein in step (b) at least one of a resonance frequency of said output transducer and a quality factor of said output transducer are analyzed.

18. The method of claim 17, wherein said impedance of said output transducer is measured by measuring a voltage on a serial resistor located between ground and said output transducer.

19. The method of claim 18, wherein said reference data includes a resonance frequency of said output transducer and said voltage on said resistor at that resonance frequency.

20. The method of claim 19, wherein in step (a) said voltage on said resistor at said stored reference resonance frequency is measured, and wherein in step (b) that measured value is compared to said stored reference voltage.

21. The method of claim 20, wherein in step (c) said status signal is provided as an alarm signal if a difference between said measured value and said stored reference value exceeds a pre-determined threshold.

22. The method claim 20, wherein in step (c) a magnitude of a difference between said measured value and said stored reference value is taken as a measure of a degree of a mechanical obstruction of said output transducer.

* * * * *